United States Patent [19]

Gotz

[11] 4,171,601

[45] Oct. 23, 1979

[54] INSULATED GLAZING UNIT

[75] Inventor: Günther Gotz, Rodheim, Fed. Rep. of Germany

[73] Assignee: USM Corporation, Farmington, Conn.

[21] Appl. No.: 884,743

[22] Filed: Mar. 9, 1978

[30] Foreign Application Priority Data

Mar. 18, 1977 [DE] Fed. Rep. of Germany ..... 2711937

[51] Int. Cl.[2] ..... E04B 2/28

[52] U.S. Cl. ..... 52/790

[58] Field of Search ..... 52/788, 790, 398

[56] References Cited

U.S. PATENT DOCUMENTS

| | | | |
|---|---|---|---|
| 2,173,649 | 9/1939 | Firner | 52/788 |
| 2,348,307 | 5/1944 | Richardson | 52/788 |
| 2,925,633 | 2/1960 | Morgan et al. | 52/790 X |
| 4,080,482 | 3/1978 | Lacombe | 52/790 X |

FOREIGN PATENT DOCUMENTS

| | | | |
|---|---|---|---|
| 953159 | 8/1974 | Canada | 52/790 |
| 2113910 | 9/1972 | Fed. Rep. of Germany | 52/790 |
| 537912 | 7/1941 | United Kingdom | 52/790 |

*Primary Examiner*—Carl D. Friedman

*Attorney, Agent, or Firm*—Benjamin C. Pollard; Richard B. Megley; Vincent A. White

[57] ABSTRACT

Frame member and insulated glazing unit including panes of glass held in spaced relation by a separator frame and a novel arrangement of adhesive and sealing material providing substantially continuous direct contact of the frame members with the panes to block passage of gas or vapor to the space between the panes.

7 Claims, 2 Drawing Figures

INSULATED GLAZING UNIT

FIELD OF THE INVENTION

This invention relates to an adhesively joined insulated glazing unit and frame member for use in the glazing unit.

BACKGROUND OF THE INVENTION

Insulating glazing units are known in which glass panes are held by means of adhesive in desired relation to a separator frame defining a dead air space between the panes and in which a channel around the periphery of the assembly is filled with a sealant material. German Laid Open Application DT-AS 23 45 169 shows such an insulating assembly which is constructed by applying a pressure sensitive adhesive to attaching surfaces of a separator frame so that the frame is held in position when it is laid down on one pane and a second pane is pressed down on the frame. The peripheral channel between the frame and portions of the panes extending beyond the frame may be filled with sealant material without displacing the separator frame.

While the above structure offers advantages in ease of assembly, the pressure sensitive adhesive tends to hold the frame out of contact with the surfaces of the glass panes and both the pressure sensitive adhesive and the sealant tend to intrude between the frame member and the glass panes to pry them apart because of the area of frame member adjacent the pane surfaces.

SUMMARY OF THE INVENTION

It is an object of the present invention to provide a double pane insulated glazing unit and frame member for use in that unit in which a novel disposition of adhesive and the relation of the separator frame to the pane surfaces cooperate to give a more impermeable barrier around the dead air space between the panes.

To this end and in accordance with a feature of the present invention, the members making up the separator frame of the insulating glazing unit have a cross-section including side portions for direct engagement with the surfaces of the panes and surface portions sloping away from the surfaces of the panes to form, with the panes, recesses for adhesive on the interior, dead air space, side of the frame members material. Sealing material fills the peripheral channel defined by the outer side of the separator frame and portions of the pane surfaces projecting beyond the separator frame.

BRIEF DESCRIPTION OF THE DRAWINGS

Reference is made to the attached drawings forming a part of the disclosure of the present application in which.

DESCRIPTION OF PREFERRED EMBODIMENT

Figure 1:
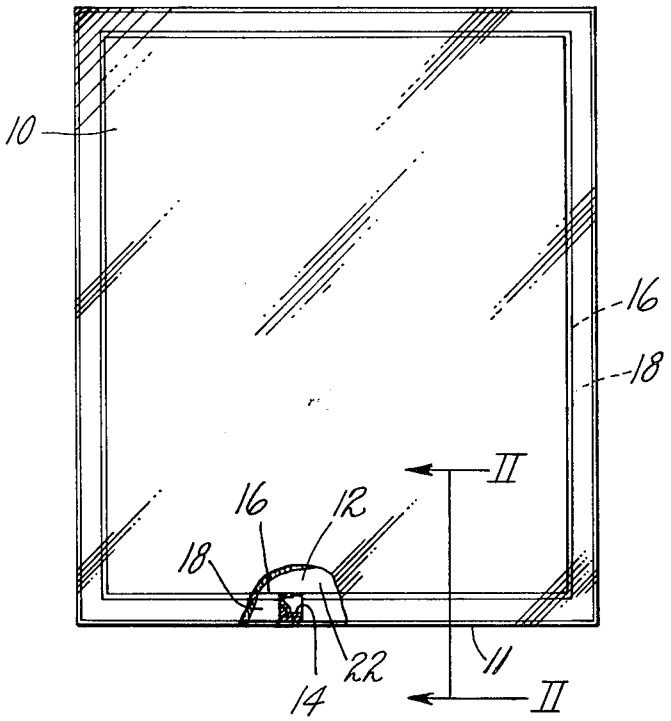
FIG. 1 is a plan view with parts broken away showing the general assembly of glass panes and separator frame.

An insulating glazing unit in accordance with the present invention includes panes of glass 10 and 12 held in spaced relation by a special separator frame 14, which may be of metal or other conventional material, and a novel disposition of adhesive 16 and sealing material 18 providing substantially continuous direct contact of central side portions 20 of the frame 14 with the panes 10 and 12 to give minimum water vapor permeability between the atmosphere and the dead air space 22 enclosed between the frame and panes. The special separator frame 14, in addition to having exterior dimensions to leave a peripheral channel defined by the outermost portions 24 of the frame members 14 and the inner faces 26 and 28 of the panes 10 and 12 extending beyond the frame 14, also provides surface portions 30 sloping away from the surfaces 26 and 28 of the panes inwardly of the central pane-engaging side portions 20 to form inward recesses 32 open to the dead air space 22, and other surface portions 34 sloping away from the surfaces 26 and 28 of panes to form recesses 36 outwardly of the side pane-engaging portions 20 of the frame member 14. The adhesive 16 is composed of a shape retaining, preferably pressure sensitive adhesive composition and disposed in the inward recesses 32, and sealing material 18 is disposed substantially to fill the outward recesses 36 and peripheral channel.

Figure 2:
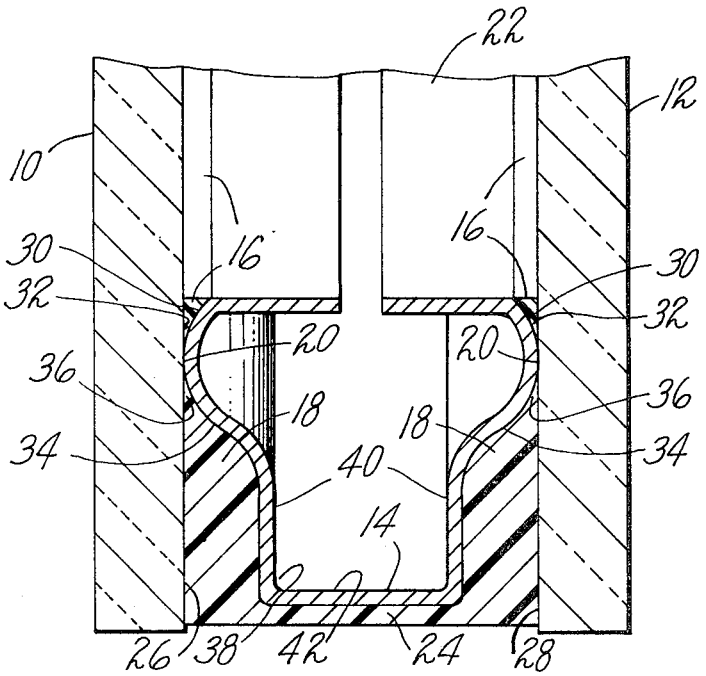
FIG. 2 is a sectional view on an enlarged scale taken on the line II—II of FIG. 1 showing the relation of the separator frame, the adhesive and the sealing material in an insulating glazing unit according to the present invention.

In a preferred form of separator frame 14, the frame members have a cross-section such that the central, pane-engaging side portions 20 make line contact when assembled with the panes 10 and 12. Thus in the separator cross-section shown in FIG. 2, rounded portions of the separator frame at each side can contact the two panes only along the line of tangency with the curved portions. Linear contact insures that the area of engagement between the frame member and the glass is very small so that pressure between the frame member and the panes is very high per unit area. This is a particular advantage since it forms a tight metal to glass joint which allows minimum or no clearance for passage of air or moisture to or from the dead air space 22. The high pressure resists displacement of the panes 10 and 12 away from the frame 14 by preventing undesired intrusion of sealant or adhesive between the separator frame 14 and the panes 10 and 12 such as might occur if the pane-engaging surfaces of the separator frame were flat areas of substantial dimensions. The frame member 14 also is preferably provided with a filler section 38 integral with the portion for extension outwardly into the channel to reduce the quantity of sealing substance 18 required to fill the channel. In the form shown, the filler section has side portions 40 providing relatively narrow spaces from the inner surfaces 26 and 28 of the panes in the channel area and an end portion 42 which is within the sealing substance 18 in the channel. This insures a maximum path in the sealing substance from the lines of tangency to the free surface of the sealing substance.

Deposition of shape retaining pressure sensitive adhesive on the inward surface portions 30 of the frame members is carried out in a way to form a profile such that the free surfaces of the adhesive 16 carried on the inward surface 30 portions are substantially parallel. This enables the frame members 14 to be laid down on and adhered to a first pane member 12 in a manner which both resists lateral displacement, prevents rotational movement of the frame members 14 about their longitudinal axes and avoids any difficulty of overflow of adhesive from the inward recesses 32.

The adhesive may be applied to the separator frame members in molten condition by means of a known wheel type applicator. The adhesive is brought to a pasty condition so that it retains the profile imparted to it by the wheel applicator, and it sets immediately in that shape retaining profile as heat is withdrawn from it by the separator frame.

The insulating glazing unit assembly can be completed by simply laying down the second pane 10 and applying a sealing substance 18 to the channel between the frame members 14 and the portions of the panes 10 and 12 beyond the lines of contact 20 with the separator frame member 14. Any sealing substance capable of introduction into the channel and setting to shape retaining condition may be used. Thus there may be used sealing substances which set by chemical action such as the polysulfide polymer sealing substances or thermoplastic sealing substances such as those based on mixtures of natural or synthetic rubbers and/or resins.

The following examples are given to aid in understanding the invention but it is to be understood that the invention is not restricted to the particular shape of separator frame member nor to the particular adhesive or sealing materials used, nor to particular temperatures or other details of the examples.

EXAMPLE 1

An adhesive composition was prepared having the following formula:

| | Percent by Weight |
|---|---|
| Thermoplastic styrene-butadiene-styrene block copolymer synthetic rubber | 10% |
| Thermoplastic styrene-isoprene-styrene block copolymer synthetic rubber | 31% |
| Hydrogenated mixed polyolefin hydrocarbon resin melting point 100° C. (Escorez) | 40% |
| Naphthenic oil | 5% |
| Polystyrene, softening point 78° C., Melt Index 9.0 | 8% |
| Ethylene Acrylic Copolymer melting point 108° C. Specific gravity 0.93 | 5% |
| UV stabilizer | 0.5% |
| Oxidation stabilizer | 0.5% |

This composition is melted and applied to separator frame members 14 on the surfaces 30 which will be sloping away from the contact line 20 internally to form profiled adhesive strips on opposed surfaces of the separator strip with their surfaces substantially parallel. The hot melt applied adhesive sets immediately on application to the separator frame so that the applied adhesive retained its shape. Separator frame members are laid down on a horizontal pane 12 to form a separator frame 14 and thereafter a second pane 10 is laid down on the frame 14 so that, under the pressure of the second pane, the pressure sensitive adhesive 16 adheres to the panes 10 and 12 to hold them in firm assembled relation. The outer channels between the separator frame members 14 and the surfaces 26 and 28 of the panes 10 and 12 are completely sealed with sealing material which enters the recesses 36 between the surfaces 34 sloping away from the panes 10 and 12 outside of the line of contact 20. The sealant used had the following composition:

| Polysulphide Mixing ratio parts A:B = 10:1 | | Parts by Weight |
|---|---|---|
| Part A. | Liquid Polysulphide | 30 |
| | Liquid Chlorinated Paraffin | 9 |
| | Calcium Carbonate | 20 |
| | Barium Sulphate | 35 |
| Part B. | Manganese Dioxide | 37 |
| | Lead Dioxide | 7 |
| | Dioctylphthalate | 53 |

-continued

| Polysulphide Mixing ratio parts A:B = 10:1 | Parts by Weight |
|---|---|
| Sulphur | 3 |

The resulting joints provide superior resistance to passage of gas or vapors to or from the dead air space 22 because the line contact of the separator members 14 with the panes minimized or eliminates any possible passage for air or moisture to or from the dead air space 22 while the length of passage through the sealing material from the line of contact to the free surface of the sealing material is large and imposes a substantial barrier to passage of volatile or gaseous materials which may pass any narrow gaps in the line contact 20 between the separator frame 14 and the panes 10 and 12.

EXAMPLE 2

The procedure of Example 1 was repeated and an insulated glazing unit similar to that of Example 1 was prepared except that the pressure sensitive adhesive used has the following composition:

| | Percent by Weight |
|---|---|
| Thermoplastic styrene/butadiene/styrene block copolymer synthetic rubber | 17.2% |
| Thermoplastic styrene/isoprene/styrene block copolymer synthetic rubber | 17.2% |
| Hydrogenated mixed polyolefin hydrocarbon resin melting point 100° C. (Escorez 5300) | 28.9% |
| Colophonium | 28.9% |
| Napthenic oil | 3.5% |
| Polystyrene | 2.6% |
| UV stabilizer | 0.4% |

The sealant applied had the following composition:

| | Parts by Weight |
|---|---|
| Butyl Rubber | 34 |
| Polyolefin Resin (Escorez 5300) | 30 |
| Methylabietate | 5 |
| Colloidal Silica | 20 |
| Carbon Black | 11 |

The sealant was applied in heat softened condition and set up promptly.

Having thus described my invention, what I claim as new and desire to secure as Letters Patent of the United States is:

1. In a double glazing unit comprising separator frame members surrounding a dead air insulating space between panes of glass, the frame members being located inwardly of the edges of the panes to form a channel defined by outer faces of the frame members and the surfaces of the panes from the frame members to the edges of the panes, and a sealing substance being disposed to fill said channel; the improvement in which the frame members have a cross-section providing central side portions in direct engagement with the surfaces of the panes to minimize or eliminate any passage for air and moisture to or from the dead space and surfaces sloping away from said panes to form, with said panes, recesses open to the dead air space inwardly of said central portions, and adhesive is disposed substantially to fill the recesses inwardly of said central portions and to adhere to the surfaces of the panes and to the surfaces of the frame members.

2. A double glazing unit as defined in claim 1 in which said frame members have a cross-section providing surfaces sloping away from said panes outwardly of said central side portions to form, with said panes, recesses open to said channel and said sealing substance extends to fill said recesses outwardly of said central side portions.

3. A double glazing unit as defined in claim 2 in which said central side portions provide substantially line contact with the surfaces of said panes over substantially their entire lengths and said adhesive is pressure sensitive and shape retaining and acts to resist substantial rotational movement of said frame members about their longitudinal axes and to resist lateral displacement of said members.

4. A double glazing unit as defined in claim 3 in which the cross-section of said frame members includes curved side portions providing said line contact at tangency with said panes and a filler section integral with said curved portions extending outwardly into said channel to minimize the quantity of sealing substance required to fill the channel while insuring a maximum length path in the sealing substance from the lines of contact of panes and frame members to the free surface of the sealing substance, said filler section having side portions spaced from the inner surfaces of said panes.

5. A frame member for use in a double glazing unit assembly to space and provide at least a portion of a seal surrounding a dead air space between panes and to form the inner wall of a peripheral channel exteriorly of said frame member between panes, said frame member having a cross-section providing parallel central side portions extending lengthwise on opposite sides of said member for direct engagement with the surfaces of the panes and surfaces sloping in from said central portions to form, when assembled between panes, recesses open to the dead air space of said assembly, and pressure sensitive, shape retaining adhesive bodies adhered to and extending lengthwise of said frame member on said sloping surfaces, said adhesive bodies having a cross-section corresponding to the cross-section of said recesses with surfaces of the adhesive bodies opposite said sloping surfaces being substantially parallel to each other to resist rotational movement of the frame member about a longitudinal axis and to resist lateral displacement of said frame member when assembled against a pane.

6. A frame member as defined in claim 5 in which said frame member has further surfaces sloping in from said central portion to provide, when assembled between panes, recesses open to said peripheral channel and in which said central side portions are narrow for providing substantially linear contact with the surfaces of said panes.

7. A frame member as defined in claim 6 in which the cross-section of said frame member includes curved side portions providing said line contact at tangency with said panes and also providing said sloping surfaces to form said inward and outward recesses, and a filler section integral with said curved portion for extension into said channel to minimize the quantity of sealing substance required to fill said channel while insuring a maximum path in the sealing substance from the lines of contact of panes and frame member to the free surface of the sealing substance, said filler section having side portions dimensioned to provide spaces from the inner surface of panes with which it is assembled.

* * * * *